United States Patent [19]

Gilreath

[11] Patent Number: 4,596,333

[45] Date of Patent: Jun. 24, 1986

[54] SHEET HOLDER

[76] Inventor: Charles T. Gilreath, 217 NW. 34th Dr., Gainesville, Fla. 32607

[21] Appl. No.: 745,362

[22] Filed: Jun. 14, 1985

Related U.S. Application Data

[63] Continuation-in-part of Ser. No. 547,210, Oct. 31, 1983, abandoned.

[51] Int. Cl.[4] ..... A47F 7/00

[52] U.S. Cl. ..... 211/51; 281/45; 312/190

[58] Field of Search ..... 211/49.1, 50, 51; 312/190, 193; 206/449, 555, 556; 281/45

[56] References Cited

U.S. PATENT DOCUMENTS

| | | | |
|---|---|---|---|
| 1,277,987 | 9/1918 | Miller | 211/51 |
| 2,164,496 | 7/1939 | Brown | 211/51 X |
| 2,547,167 | 4/1951 | Nielsen | 312/190 |
| 4,056,193 | 11/1977 | Yoshida | 211/51 |

*Primary Examiner*—Robert W. Gibson, Jr.
*Attorney, Agent, or Firm*—Charles A. Bevelacqua

[57] ABSTRACT

A sheet holder for releasably restraining a stack of sheets of varying thickness so that operations such as writing or drawing can be performed on the top sheet. The sheets are supported on a stack support shelf secured to a base. A retainer is pivoted to the same base and has a portion which overlies the front edge of a stack of sheets on the support shelf. A rubber band, spring or other elastic member may be provided to apply a force to the retainer urging it into retaining engagement with the stack of sheets and an alignment member acts as a guide to maintain the sheets in the stack in alignment with each other. The elastic member and the alignment member may be the same part. In one embodiment the retainer also serves as a hand rest for a person performing operations on the stack of sheets. A prop or leg may be provided to releasably hold the retainer out of contact with the stack of sheets so that sheets may easily be added or removed. The alignment member is operative to maintain the stack of sheets in substantial alignment even when the retainer is held out of contact with the stack of sheets and the retainer will maintain stabilizing pressure on the sheets whether there is a relatively thick stack of sheets or only a single sheet on the support shelf.

Various alternative constructions are shown and described.

17 Claims, 16 Drawing Figures

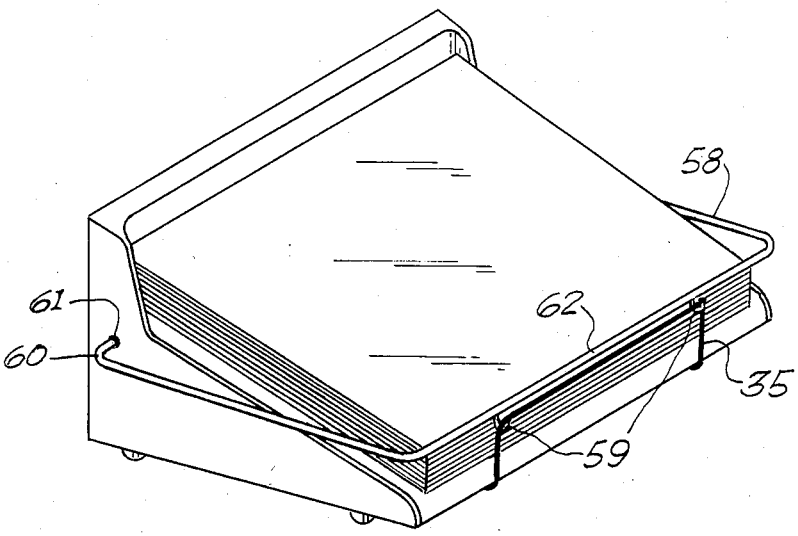
Figure 10.
Figure 14.
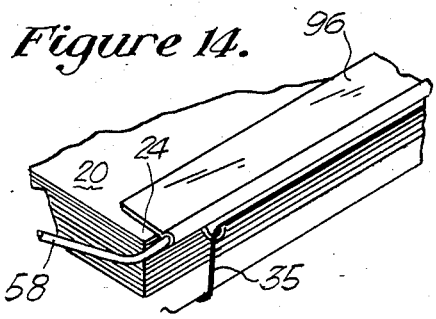
Figure 11.
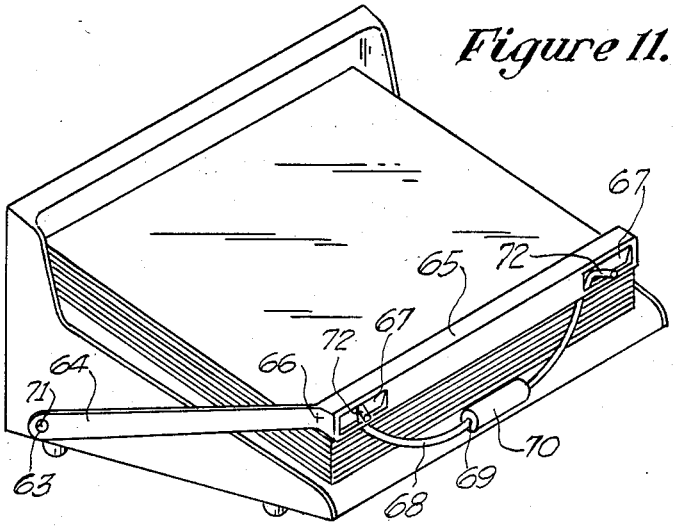
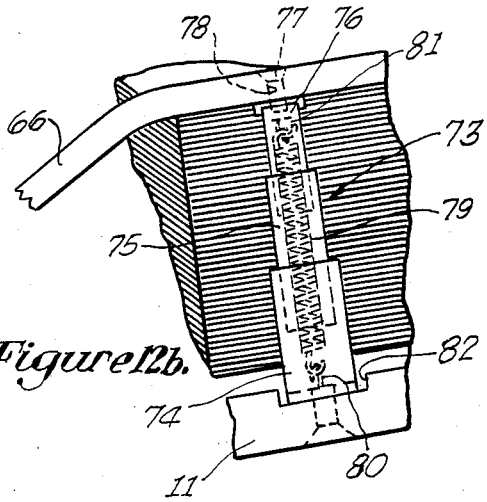
Figure 12b.
Figure 12a.
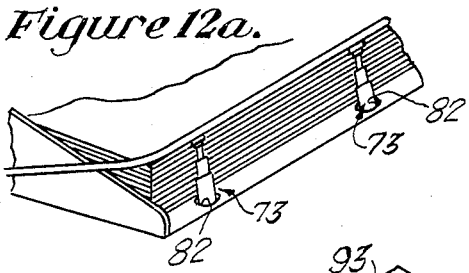
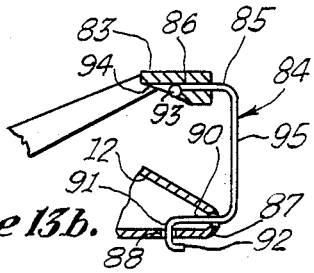
Figure 13b.
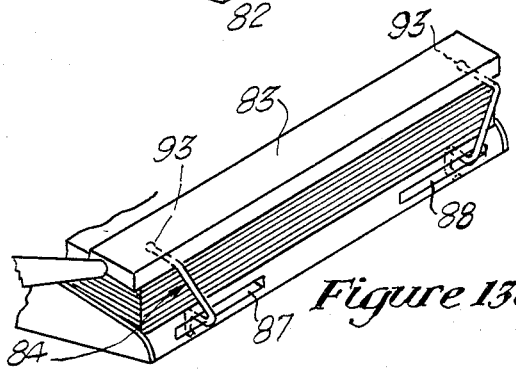
Figure 13a.

SHEET HOLDER

This is a continuation-in-part of application Ser. No. 06/547,210 filed Oct. 31, 1983 now abandoned.

BACKGROUND OF THE INVENTION

This invention relates to apparatus for holding sheet material and retaining it in an aligned stack and is particularly concerned with a writing station of the hand-rest type for holding note paper or cards.

Note paper holders of the prior art may be generally classified as of two types: (1) single tray units which have a flat bottom and three or four vertically extending continuous sides or which have corner brackets at each of the four corners to retain the paper and (2) hand-rest units which in addition to a receptacle for holding the paper, have an adjacent surface on which the writer can rest his hand. Many hand-rest units also have means to stablize the paper.

Single tray units are inconvenient and impractical for writing on the top sheet of paper while it is still within the tray. Typically, the writer must first remove the sheet from the tray and place it on a writing surface stablizing the sheet with one hand and writing with the other. The most advantageous of the hand-rest units provide a paper receptacle in which the front and most of the two sides are open and the hand-rest surface is adjacent to and overlapping the front edge of the paper. The base of the paper receptacle extends forward and the hand-rest surface is hinged to the front edge of the base. This permits the rear edge of the hand-rest surface, which overlaps the paper, to press down on the top sheet of paper helping to retain it in place while it is being written on. The hand-rest also includes a vertically downward depending flange which helps hold all the sheets in the stack in alignment and further stablizes the top sheet while it is being written on.

While definitely an improvement over single tray units, presently known hand-rest units have a number of disadvantages and problems. Since the hand-rest surface must continue to move downward as the sheets in the stack are depleted in order to perform its function of holding the stack and of providing a hand-rest surface at about the same level as the top of the stock, the base of the unit must be fairly high to provide clearance for the guide flange as the hand-rest surface moves downward. This increases the size of the holder and also provides a sharp, relatively high step between the hand-rest surface and the desk top or other support on which it is placed which makes it awkward and uncomfortable for the writer. In addition, although the hinged hand-rest is the most convenient handle by which the unit can be picked up and moved, particularly in units designed for small sheets, if the unit is moved by picking it up by this hand-rest, the hand-rest surface will move upward, releasing pressure from the sheets in the stack and displacing the guide flange, permitting the sheets to slide out of place and become disarrayed.

SUMMARY OF THE INVENTION

The present invention provides a hand-rest sheet retainer which utilizes a flexible member or an extensible member in place of a rigid guide flange to retain the front edges of the sheets in alignment and may utilize the same a retainer member to apply a resilient tensile force to the hand-rest, constantly urging it to exert pressure on the top sheet of the paper in the tray. The tensile force may be supplied by an elastic band or a spring. In the preferred enbodiment, a single elastic member in the form of a rubber band provides both the aligning function and the tensioning function. The structure described eliminates the rigid guide flange, permits the sheet retainer to be made with an extermely thin base and enhances the portability and ease of handling the unit by making it possible to grasp it by the hand-rest without losing the function of the guide flange, even though the hand-rest is displaced vertically and pressure is removed from the top sheet of the stack of sheets.

The invention is illustrated and described as a holder for note paper, cards or the like for use on a desk top or similar support surface. It is obvious that a sheet holder made in accordance with the teachings of the invention can be made in larger sizes and of greater ruggedness so that it could function to hold artist's canvases, wood sheets or even sheets or plates of metal.

It is an object of the present invention to provide a sheet holder and writing or work station with increased portability and handling characteristics by utilizing a flexible or extensible member to hold the front edge of a stack of sheets in alignment.

It is another object of this invention to provide a guide for the front edge of sheets in an inclined stack which also acts as a tensioning member for a retainer which is used to apply downward pressure to the top sheet of a stack of sheets of material.

Another object of this invention is to provide a sheet holder with a sheet retainer which may also function as a hand rest.

Another object of this invention is to provide a sheet holder with a hand-rest surface which remains in substantial alignment with the top surface of a stack of sheets and with an adjoining support surface, whether the stack of sheets is at the approximate full capacity of the retainer or is virtually depleted.

Still another object is to provide a sheet holder with means to maintain the hand-rest member out of pressure applying engagement with the stack of sheets which it is retaining so that all or any portion of the stack can be easily removed or additional sheets added to the stack.

It is also an object of this invention to provide a sheet holder in which a guide is provided to maintain the front edges of the sheets in substantial alignment whether the hand-rest member is in pressure applying engagement with the stack of sheets, is being held out of pressure applying engagement or is momentarily out of such engagement by virtue of the sheet holder having been lifted by grasping the sheet retainer.

These and other objects, features and advantages of this invention will become apparent from the following description in conjunction with the accompanying drawings.

BRIEF DESCRIPTION OF THE DRAWINGS

FIG. 10 shows an alternate form of the invention of FIG. 1.

FIG. 11 is a view similar to FIG. 10 but with alternative forms of retainer and alignment means.

FIG. 12*a* is a fragmentary view of another form of alignment means.

FIG. 12*b* is an expanded view of one alignment member shown in FIG. 12*a*.

FIG. 13*a* is a fragmentary view of still another form of alignment member.

FIG. 13*b* is an expanded view of one alignment member shown in FIG. 13*a*.

FIG. 14 is a fragmentary view of a modified form of the invention as shown in FIG. 10.

DESCRIPTION OF THE PREFERRED EMBODIMENT

Figure 4:
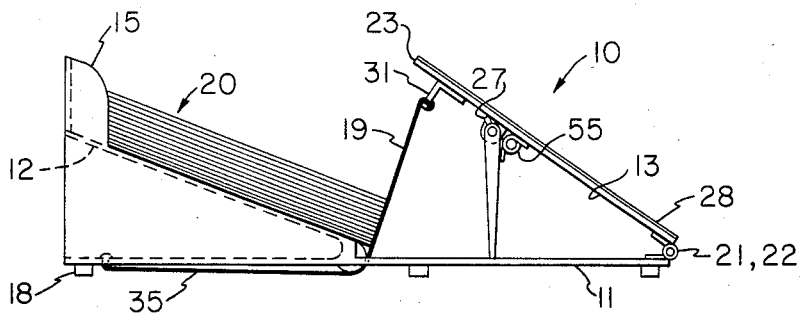
FIG. 4 is a side elevational view similar to FIG. 1 but with the retainer plate propped up to permit the removal or insertion of sheets.
Figure 7:
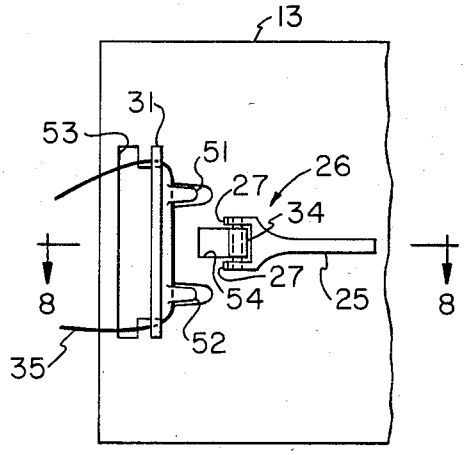
FIG. 7 is a bottom view of a portion of the retainer plate showing an alternative structure in which parts are formed from material taken from the retainer plate.

Referring to FIGS. 1–9 of the drawings, the sheet holder 10 comprises a base 11, a sheet support shelf or plate 12, a sheet retainer or hand rest 13 and corner brackets 14 and 15. The base, sheet support plate and corner brackets may be formed or molded integrally from a suitable metal or plastic or can be made of separate pieces and joined together by cementing or welding or by using any suitable fasteners such as screws or rivets. Side plates or members 16 and 17 may be added if additional rigidity and stability of the sheet holder is desired. A suitable number of support feet 18 are provided to help prevent sliding of the base and marring of the surface on which it rests. As will be seen, the hand rest 13 also performs the function of holding down the sheet or stack of sheets on the sheet support plate 12. Together with the stack retainers or alignment means 19 it helps hold a stack of sheets 20 or a single sheet in stabilized, aligned position. The support shelf as shown is preferably at an angle to the base so that sheets supported on the shelf can comfortably be written on. The hand-rest 13 is pivotally attached to the base 11 by suitable means such as hinges 21 and 22 which are illustrated. The hand-rest is positioned and proportioned so that the upper or free edge 23 will overlap and rest across the front portion 24 of the top sheet of the stack of sheets in the sheet holder. A suitable prop to support the hand-rest in the position as shown in FIG. 4 where it is raised above the top sheet of the stack of sheets is also provided. As best illustrated in FIG. 7, the prop can take the form of a leg 25 secured by some suitable pivot means 26 to the underside of the hand rest. One or more stops 27 may be provided to stop the pivotal movement of the leg at the point where it is substantially perpendicular to the base 11. These stops are shown as shoulders or tabs, formed on the pivot portion of the leg, which abut the underside of the hand-rest.

Figure 1:
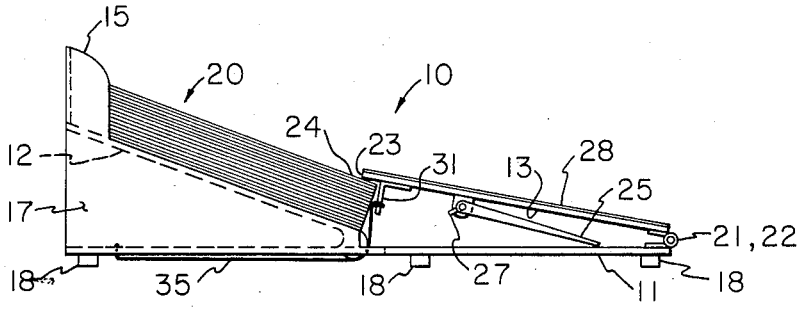
FIG. 1 is a side elevational view of one from of the sheet holder with a substantially full stack of sheets.
Figure 2:
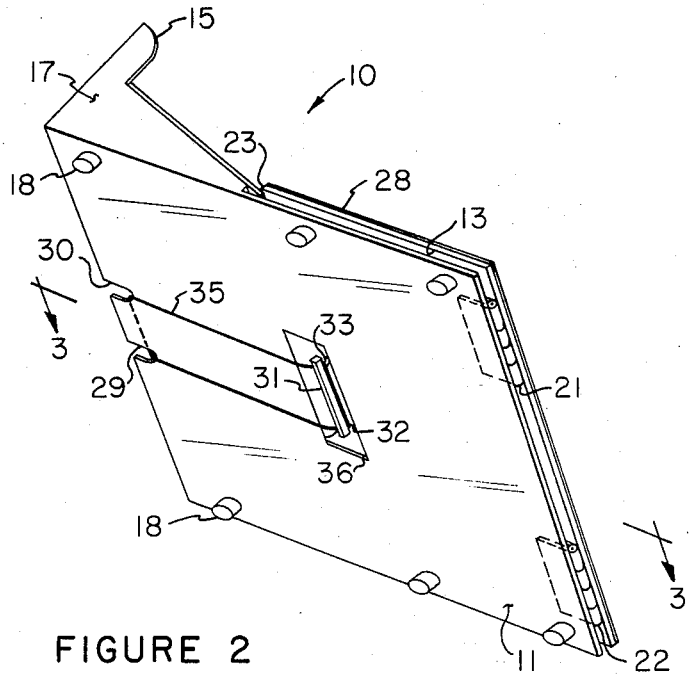
FIG. 2 is a bottom perspective view of the sheet holder of FIG. 1 with only a single sheet of material.
Figure 3:
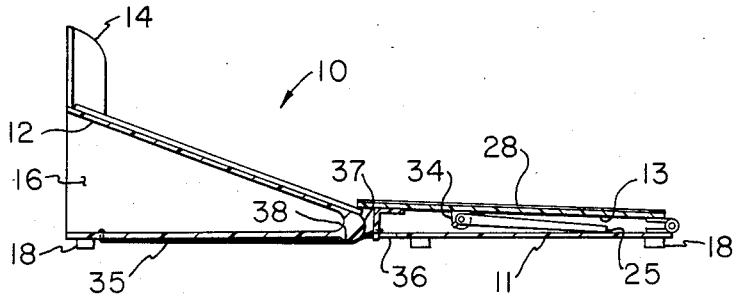
FIG. 3 is a cross sectional view of the sheet holder of FIG. 1 taken along the line 3—3 in FIG. 2.

The hand-rest or retaining plate 13 may be made of plastic, metal or any other suitable rigid material capable of being made in thin sheets and still have the strength to suitably support the hand of the person who is writing on the stack of sheets or performing some other similar function. A thin plate of aluminum which may be tampered has been found suitable for this purpose. A surface layer 28 of suitable material to provide additional smoothness, color or softness may be suitably adhered to the exposed or top surface of plate 13. As seen in FIG. 2, the base 11 is formed with notches 29, 30 at its rear edge and a guide flange 31 formed with suitable notches 32, 33 is attached to the underside of hand rest 13 by means of screws, an adhesive, welding or other suitable means. As shown in FIG. 7 the guide flange and retaining notches can be made integral with plate 13 by stamping or forming them out of the material of the plate. The portion 34 of the hinge for the support leg 25 can also be made integral with plate 13 or stamped out of it. A suitable flexible, endless elastic band 35 is engaged in the notches 29 and 30 in the base 11 and in the notches 32 and 33 on the guide flange passing through the opening 36 in the base 11. Elastic band 35 can be a readily available rubber band, a spiral spring of relatively small diameter made into a loop or any other suitable elastic material. The opening 36 can be a simple rectangular opening cut into or molded or otherwise formed in the base 11 adjacent the sheet support plate 12. The juncture between shelf 12 and base 11 which lies within the opening 36 can be formed with a smooth curved nose 37 and a bulge or projection 38 extending slightly below the bottom surface of the base 11. The nose 37 presents a smooth surface that will not interfere with the stretching and sliding movement of elastic band 35 and the projection 38 reduces friction between the bottom of the base and the elastic band and also helps impart a vertical component to the force applied by the elastic band to the retainer plate when only a single sheet or low stack of sheets is on support plate 12.

The portions of the band 35 which extend from the bottom of the retaining plate 13 through the opening 36 or openings 41 and 42 in base 11 form stack retainers 19 which maintain the front edges of sheets in stack 20 in substantial alignment. The stack retainers 19 are effective in at least all positions of plate 13 in which it forms an acute angle with base 11. The spacing between retainers 19 is not critical but it will be readily recognized that as they are placed closer together they will become less effective in maintaining alignment of the sheets.

Figure 5:
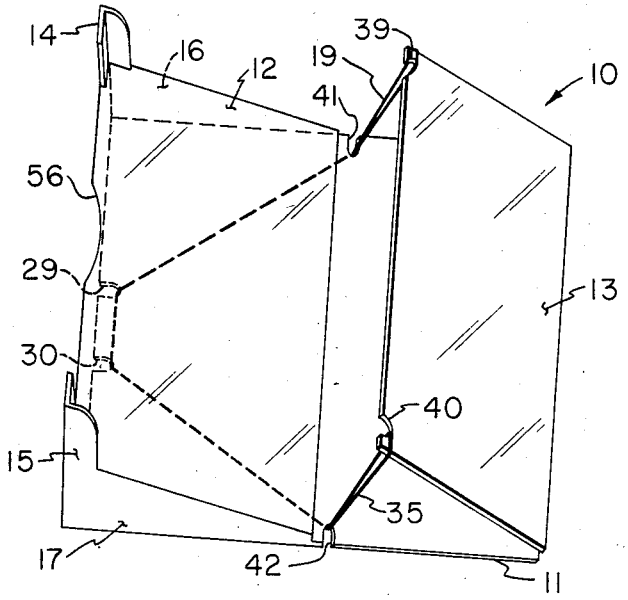
FIG. 5 is a top perspective view showing the sheet holder of FIG. 1 with an alternative manner of routing and attaching elastic tensioning means for the retainer plate.
Figure 9:
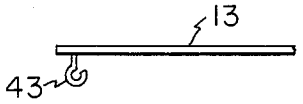
FIG. 9 is a fragmentary view of an alternative structure for attaching the tensioning means to the retainer plate.

In the alternative construction shown in FIG. 5, the guide flange 31 is eliminated and the elastic band 35 has its ends hooked through notches 39 and 40 in the retainer plate 13 and is threaded through notches 41, 42, and 29, 30 in the base plate. This also makes unnecessary the opening 36 in the base. As shown in FIG. 9, the notches 39 and 40 in FIG. 5 can be replaced by hook means 43 attached to the underside of plate 13 or formed out of material integral with or stamped out of plate 13. In any of the above structures, two or more elastic elements may be substituted for the single elastic band 35.

Figure 6:
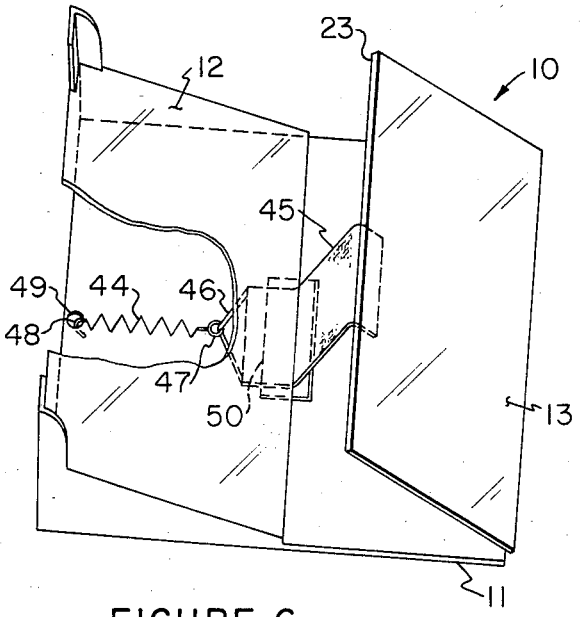
FIG. 6 is a view similar to FIG. 5 but with an alternative form of elastic means and flexible stack retainer and with the sheet support plate being partially broken away.

As shown in FIG. 6 a flexible fabric belt 45 can serve as the stack retainer. One end of the belt is suitable attached to the underside of hand-rest 13 by cementing, crimping in a metal bracket or attaching to a flexible loop of material which is strung through notches 32, 33 in the guide flange 31. If the flexible fabric is attached directly to plate 13, guide flange 31 may be eliminated. The other end of the belt 45 is provided with a loop 46 of flexible material integrally formed or suitably attached to the belt. FIG. 6 shows the flexible fabric utilized with a spring 44 connected between the loop 46 and the base 11. As shown, spring 44 is located on top of base 11 and is provided with a loop 47 at one end through which can be threaded the flexible loop 46 and at its other end is provided with a hook 48 which can be inserted into a hole 49 or other suitable attaching means on the base 11. The spring 44 or other tensioning means may be located on the top or bottom of base 11. When located on top less clearance is required between the base and the surface on which the sheet holder is placed and opening 49 must be proportioned so that flexible member 45 can be threaded back to the top of the base. It would also be possible to modify the construction by making the belt 45 itself of an elastic material and attaching the loop 46 directly to the base 11 without spring 44. As another alternative, elastic material can be used for the loop 46 only. Loop 46 could then serve as the elastic tensioning means. Of course, it would also be possible to utilize a spring 44 in combination with a belt 45 of elastic fabric or in combination with flexible, non-elastic fabric and an elastic loop 46. With the addition of suitable parts well known in the art, one or more leaf springs or a compression spring could be substituted for the tension spring 44 or a torsion spring operating like the torsion spring in a roll-up window shade could be used to supply tension to the belt 45. A spiral, torsion or leaf spring could also be used in combination with the elastic band 35 shown in FIGS. 1–4.

Figure 8:
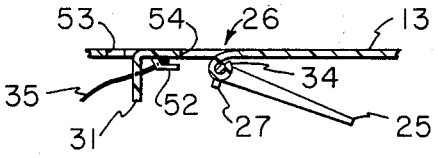
FIG. 8 is a partial view in cross section taken along the line 8—8 in FIG. 7.

FIGS. 7 and 8 illustrate a slightly different form of guide flange and retainer for elastic band 35 on the underside of retainer plate 13. As shown, the guide flange 31 and tabs 51 and 52 are stamped or formed out of the material of plate 13, leaving the opening 53 and smaller openings from which the material is taken for the tabs 51 and 52. Either the tabs 51 and 52 or the guide flange could be omitted from this construction without impairing the operation. As previously mentioned, a portion 34 of the hinge for leg 25 can also be stamped from plate 13, leaving an opening 54. Although these openings would probably not interfere with the use of the plate 13 as a hand rest, this construction is best suited for use when an additional layer of material 28 is to be used on the hand rest as previously described.

Shelf 12 may be provided with an access notch 56 to facilitate grasping a stack of sheets.

The form of the invention shown in FIGS. 10 through 14 is the same as that shown in FIGS. 1 through 9 except that the front portion of the base 11 between the nose 37 and hinges 21 and 22 has been eliminated to reduce the amount of space occupied by the sheet holder and the retainer for the stack of sheets is pivoted from the base at a point behind the front edge of the stack of sheets 20. It should be noted that any of the stack retainers and alignment members shown in FIGS. 1 through 9 may be used with the sheet holder shown in FIGS. 10 through 14 and any of the stack retainers and alignment members shown in FIGS. 10 through 14 may be used with the sheet holder shown in FIGS. 1 through 9.

Referring now to FIG. 10 it can be seen that the base 11 is approximately the same length as the stack of sheets 20. In this case the stack of sheets 20 is held down by a sheet retainer in the form of a U-shaped wire bail 58 which has a pair of depending hooks 59 to which are attached the elastic band 35. As shown, the wire bail 58 is of round cross section and has suitable bent ends 60 which are inserted in suitable apertures 61 so that the retainer can be pivoted into and out of engagement with the top of the top sheet on the stack 20. The middle or bight portion 62 of the bail 58 may be flattened to provide more effective contact with the sheets and to provide a more comfortable hand rest.

A variation of the sheet holder of FIG. 10 is shown in FIG. 14 in which the wire bail 58 is made slightly longer so that it just passes over the front edge 24 of the stack of sheets and a stub retainer plate or hand rest 96 is pivotally attached to the bight portion of the bail.

FIG. 11 shows a slightly different form of retaining and aligning means. In this configuration, pins 63 are integrally formed with or suitably secured to the base 11 and receive and support a U-shaped retainer 66 of substantially flat material. The retainer 66 has a pair of retainer arms 64 interconnected by a bar 65. Each of the arms 64 is provided with an aperture 71 to pivotally support the retainer on the pins 63. The bar 65 is formed with a pair of through slots 67 to receive the ends 72 of alignment member 68. Alignment member 68 is made of an elastic material which is substantially rigid, such as a spring wire. The mid portion 69 of the alignment member 68 is secured to the base 11 by securing member 70. As shown 70 is a molded projection on the base 11 having an opening therein to receive and hold the member 68 and restrainably hold it to the base 11. The ends 72 of the alignment member 68 pass through slots 57 in the bottom of bar 65 and slide freely in the slots 67 and will permit the retainer 66 to be pivoted into and out of engagement with the stack of sheets. The alignment means 68 is of a size and shape to permit retainer member 66 to be raised higher than the highest stack of sheets to be placed on the support shelf 12 but to apply an elastic force to hold retainer 66 and bar 65 into retaining engagement with even a single sheet placed on the support shelf. The portions of the retainer 66 between the ends 72 and the securing means 70 are shaped and positioned to retain the front edges of the sheets in the stack of sheets placed on the support shelf 12 in substantial alignment in any position of retainer 66 within the movement permitted by the size and shape of alignment member 68 and the length of the slots 67. The connecting bar is made as thin as possible so that it will provide a comfortable rest for the hand of the user.

FIG. 12 shows another embodiment of the invention in which the alignment means and elastic member are in the form of a telescoping device generally referred to by the numeral 73, which may have three telescoping sections 74, 75 and 76. The base 11 is provided with an opening 82 suitable to receive the telescoping means. The bottom section 74 is secured to the base of the sheet holder by suitable means and the top sections 76 is attached to the retainer 66. In the drawing the top section is shown secured by a screw 77 which passes through an aperture 78 in the retainer 66. Suitable elastic means such as the spring 79 may be used to provide a force urging the retainer 66 downward against a stack of sheets on the support shelf. The spring may be attached to a suitable attaching loop 80 in the base of the telescoping device and a similar loop 81 in the top section 76. Optionally, the elastic means may be omitted and the retainer 66 allowed to operate by gravity only. The size, shape and position of recess 82 and telescopic member 73 are selected so that the bight portion of retainer 66 will engage even a single sheet placed on shelf 12. If necessary the telescopic device may be made with more or less telescoping sections than the 3 sections shown.

FIG. 13 shows still another form of alignment means for use with the sheet holder. The alignment means 84 as shown in FIG. 13 is in the form of a rigid member, such as a wire, having a laterally extending portion 90, a downwardly extending portion 91 and a bottom end 92. The portion 90 extends through a slot 87 in the front edge of the base and is slideable therein. The portion 91 is slideable in a slot 88 in the base of the sheet holder. The bottom end 92 of the retainer is bent back to help hold the retainer in the desired path. The upper end portion 85 of alignment member 84 is pivotable in a bore 86 and has suitable means such as the enlargement 93 to hold it in the bore. The recess 94 in the bar 83 provides clearance for the end 93 of the alignment member between the bar 83 and the top of a stack of sheets on shelf 12. A pair of alignment members 84 are provided to promote even and smooth operation of the sheet holder. If desired, the end portions 92 may be urged together by elastic means, not shown, such as a spring or elastic band. This would bias the bar 83 downward against the stack of sheets 20.

As can readily be seen the portion 95 of alignment member 84 is effective to keep the stack of sheets 20 in aligned condition. As the stack of sheets is depleted, the upper end portion 85 of member 84 will pivot in the bore 86 and the lower portion will slide in the slots 87 and 88 inwardly from the ends of the sheet holder. The slots are made long enough to permit the bar 83 to come in contact with the support shelf 12 when there is no material on the shelf. The upward movement of the bar 83 is limited by the extent of the slots in the outward direction and the length of the portion 95 of the alignment member 84. These parts are arranged and of a size to permit the bar 83 to be raised higher than the maximum thickness of a stack of sheets to be set on the shelf 12. If desired, the outer ends of slots 87 may be made to extend outside a vertical plane passing through portion 85 of member 84 so a toggle action will result when the portion 90 of member 84 is moved to the outer end of the slot. This will hold bar 83 free of a stack of sheets 20 so sheets can readily be added to or taken from the stack.

OPERATION

Operation of the sheet retainer will be described in accordance with the embodiment depicted in FIGS. 1 through 4 utilizing the continuous loop elastic band or continuous loop spring of relatively small diameter. The loop is threaded through notches 32, 33 of guide flange 31 through the opening 36 in base 11 and through the notches 29 and 30 at the rear of the base. The band 35 should be of such length that it is in tension when the sheet retainer is in the position shown in FIG. 2; that is; with the sheet retainer in substantially its full downward position with only a single sheet of material on support shelf 12. When this is done the retainer 13 is grasped and pivoted about hinges 21, 22 in an upward direction until there is room for leg or prop 25 to swing to the position where it is substantially perpendicular with the surface of base 11 as shown in FIG. 4. Leg 25 will swing into this position by gravity but it is optional to provide a prop spring 55, which may be a torsion spring or other suitable device, in a manner well known in the art to urge the leg in that direction. Stops or tabs 27 on the leg pivot will stop the leg in the position in which it will act as a prop, holding the hand rest 13 in the position shown in FIG. 4. The stack retainer portions 19 of the elastic band 35 will be tensioned by this action so they will become relatively rigid and capable of acting as stack retainers. An appropriate stack of sheets 20 is then place on shelf 12 between corner brackets 14 and 15 and the stack retainers 19. Hand rest 13 is then grasped and pivoted upwardly against the tension of band 35 and the entire assembly tilted so that gravity will cause leg 27 to assume the approximate angular position shown in FIG. 1. Hand rest 13 is then released and will drop down to the position shown in FIG. 1 in which the guide flange 31 and stack retainers 19 cooperate to retain the front edge of the stack in aligned position and the upper edge 23 of plate 13 rests firmly on the front edge 24 of the top sheet of the stack of sheets. The top sheet will be held relatively securely stationary with the assistance of corner brackets 14 and 15 so it can be written on or other operations performed on it. If leg 25 is biased by a spring 55, it will be necessary to manually urge prop 27 against the action of that spring to a position where it will slide down out of locking position when the retainer plate is released.

It is obvious to those skilled in the art that although the invention has been shown and described in a limited number of embodiments, many variations may be made in the forms and structures here presented without departing from the scope of the present invention as set forth in the appended claims.

What is claimed is:

1. In a sheet holder for releasably restraining a stack of sheets of varying thickness, a stack support shelf, a retainer plate pivotable about one edge portion and having a second edge portion opposite said one edge portion, said retainer plate being positioned so that said second edge portion and a portion of said retainer plate adjacent to said second edge portion overly the front edge of a stack of sheets placed on said support shelf, elastic means attached to said retainer plate and effective to apply a force urging the overlying portion of said retainer plate into retaining engagement with said stack of sheets, and flexible means connected between said retainer plate and said elastic means, said flexible means being effective to maintain the front edges of the sheets in substantial alignment with one another.

2. A sheet holder as set forth in claim 1 wherein said stack support shelf and said retainer plate are secured to a common base.

3. A sheet holder as set forth in claim 1 including further means for releasably holding said retainer plate in a position displaced from the portion of the stack of sheets which it overlies so that sheets can readily be added to or taken from the stack.

4. A sheet holder as set forth in claim 3 wherein said flexible means remain effective in the displaced position of the retainer plate to help maintain the front edges of all the sheets remaining in or added to the stack in substantial alignment with one another.

5. A sheet holder as set forth in claim 1 wherein said elastic means and said flexible means constitute a single member.

6. A sheet holder as set forth in claim 5 wherein said single member is a rubber band.

7. A sheet holder as set forth in claim 5 wherein said single member is constructed in a continuous loop.

8. A sheet holder as set forth in claim 5 wherein said single member is a flat belt.

9. A sheet holder as set forth in claim 2 wherein said base has at least one opening therein through which said flexible means pass.

10. A sheet holder as set forth in claim 9 wherein at least one of said openings is located inwardly of the edges of the base.

11. In a sheet holder for releasably restraining sheets arranged in a stack of variable thickness, a base, a stack support shelf, a retainer plate pivoted to said base about a first edge portion and having a second edge portion opposite said first edge portion, said retainer plate being positioned so that said second edge portion and a portion of the retainer plate adjacent thereto overly the front edge of a stack of sheets placed on said support shelf, means, including elastic means and retainer portions, connected between said retainer plate and said base, said retainer portions being interposed between said elastic means and said retainer plate, said elastic means being effective to apply a force urging the overlying portion of said retainer plate into engagement with the top of said stack of sheets and said retainer portions being effective to maintain the front edges of the sheets in substantial alignment with one another.

12. A sheet holder as set forth in claim 11 wherein said retainer plate can be pivotally displaced from the stack of sheets which it overlys so that sheets can readily be added to or taken from the stack, said retainer portions remaining effective to maintain the front edges of all sheets remaining in or added to the stack in substantial alignment with one another in any position of the retainer plate in which it forms an acute angle with the base at the point where it is pivoted to the base.

13. In a sheet holder for releasably restraining sheets arranged in a stack of variable thickness, a base, a stack support shelf, a retainer plate pivoted to said base about a first edge portion and having a second edge portion opposite said first edge portion, said retainer plate being positioned so that said second edge portion and a portion of the retainer plate adjacent thereto overly the front edge of a stack of sheets placed on said support shelf, said retainer plate being pivotally displaceable from the stack of sheets which it overlys so that sheets can readily be added to or taken from the stack, means connected between said retainer plate and said base effective to maintain the front edges of the sheets in substantial alignment with one another and said means being extensible so that they remain effective to keep the sheets in alignment while the retainer plate is in a position displaced from said stack of sheets.

14. In a sheet holder for releaseably restraining sheets arranged in a stack of variable thickness, a base, a stack support shelf, retainer means pivotable into and out of a position wherein a portion of said retainer means overlies and engages the top sheet in said stack of sheets adjacent the front edge thereof, said retainer being pivotally displaceable from contact with the stack of sheets so that sheets can readily be added to or taken from the stack, alignment means connected between said retainer means and said base, said alignment means being effective to maintain the front edges of the sheets in substantial alignment with one another and being extensible so that they remain effective to keep the sheets in alignment while the retainer plate is in a position displaced from said stack of sheets.

15. A sheet holder as set forth in claim 14 wherein said alignment means comprise a flexible member lying in a plane contiguous with and substantially parallel to the front edge of the stack of sheets when said stack is in an aligned condition.

16. A sheet holder as set forth in claim 14 wherein said alignment means comprise at least one rigid arm movable in a plane contiguous with and substantially parallel to the front edge of the stack of sheets when said stack is in an aligned condition.

17. A sheet holder as set forth in claim 14 wherein said alignment means comprise at least one telescoping member.

* * * * *